United States Patent [19]

Thompson

[11] 4,164,113

[45] Aug. 14, 1979

[54] SPINDLE DRIVE ADAPTER

[75] Inventor: N. H. Thompson, Anderson, S.C.

[73] Assignee: Superior Bands, Inc., Anderson, S.C.

[21] Appl. No.: 937,542

[22] Filed: Aug. 28, 1978

[51] Int. Cl.[2] ..... D01H 1/26; D01H 7/04

[52] U.S. Cl. ..... 57/104; 57/93

[58] Field of Search ..... 57/16, 17, 18, 92, 93, 57/104; 242/18 R, 18 CS; 74/242, 242.3, 242.4, 242.6, 217 S

[56] References Cited

U.S. PATENT DOCUMENTS

| | | | |
|---|---|---|---|
| 2,220,006 | 10/1940 | Walsh et al. | 57/18 |
| 2,224,110 | 12/1940 | Walsh | 57/93 X |
| 3,124,924 | 3/1964 | Smith | 57/18 |
| 3,248,961 | 5/1966 | Bortzfield et al. | 74/242.3 |
| 3,555,917 | 1/1971 | Louzil et al. | 74/242.3 |

*Primary Examiner*—Donald Watkins

*Attorney, Agent, or Firm*—Bailey, Dority & Flint

[57] ABSTRACT

An adapter pulley for increasing the speed of a spindle drive of a rubber covering textile machine includes an adaptor body member having a tapered drive belt transfer surface tapering inwardly to a reduced drive pulley portion.

4 Claims, 4 Drawing Figures

SPINDLE DRIVE ADAPTER

ORIGIN OF THE INVENTION

Textile twisting machines are commonly used for covering a strand of material with a yarn by passing the strand through the center of a spindle on which a package of yarn is carried for rotation. The yarn is subsequently twisted around the strand by a rotating flyer to cover the strand. One particular machine of this type is made by the H. H. Arnold Co., Inc. of Rockland, Mass. Which is used primarily for covering a strand of rubber with a textile yarn by twisting the yarn around the rubber strand with the resulting product being covered elastic-type cord. Typically, two vertically spaced packages of yarn are utilized on vertically spaced spindles and the yarn is wrapped in opposite directions to completely cover the rubber strand. The spindles are driven by semi-elastic drive belts which are economical on power and produce uniform spindle speeds. However, the problem with prior spindle drive arrangements on such machines is that to increase production by increasing the speed at which the spindles are driven requires modification of the output drive gear arrangement which is fairly expensive and complicated.

Accordingly, an important object of the present invention is to provide a device by which a conventional spindle drive on a twisting machine may be adapted for increased drive speed and hence production output of the machine.

Another important object of the present invention is the provision of a high speed pulley adapter for use on a spindle drive of a twisting machine which requires no modification to the machine or remaining spindle drive.

SUMMARY OF THE INVENTION

It has been found that an adapter drive pulley member can be provided for increasing the speed of a spindle drive of a textile twisting and covering machine of the type having a belt driven spindle unit which includes a bearing block base adapted for mounting to a frame of the machine, a central bearing bore in the bearing block base receiving and holding a rotatable spindle shaft in an upright position, wherein the adapter drive pulley member includes a lower base portion, a drive pulley portion having a groove of reduced circumference, and a drive belt transfer surface extending between the base portion and drive pulley portion tapering inwardly to the drive pulley groove.

BRIEF DESCRIPTION OF THE DRAWINGS

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
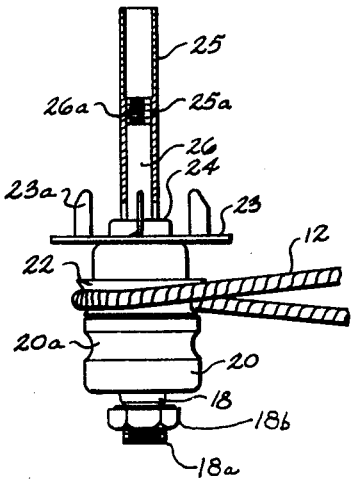
Fig. 1 PRIOR ART
FIG. 1 is an elevation illustrating a front view of a prior art spindle drive unit.

The invention relates to an adapter drive pulley for increasing the speed of a spindle drive on a textile twisting and covering machine. The invention has particular advantages in the application for increasing the drive speed of a spindle on a machine made primarily to cover rubber manufactured by the H. H. Arnold Co. of Rockland, Mass. The Arnold spindle unit utilized on such rubber covering machines is illustrated in the prior art FIG. 1. The basic principle of the Arnold rubber covering machine being shown in FIG. 2 wherein spindle drive units, generally designated as A, are illustrated as incorporating adapter pulley members B constructed in accordance with the present invention. The machine typically includes a frame 10 having horizontal frame elements 11 upon which the spindle drive units A are carried driven by a drive belt 12 in a manner to be more fully hereinafter explained. The belt 12 is driven by an output drive pulley 13 which is in turn driven in a conventional manner by the motor drive unit of the machine (not shown). Yarn packages 14 are carried on the vertically spaced spindle units A. A rotating flyer 15 travels with each package 14 and wraps yarn from the package around a strand of rubber 16 passing through the center of the spindle unit, all of the above operating being well known in the art of textile twisting and covering machines.

Figure 2:
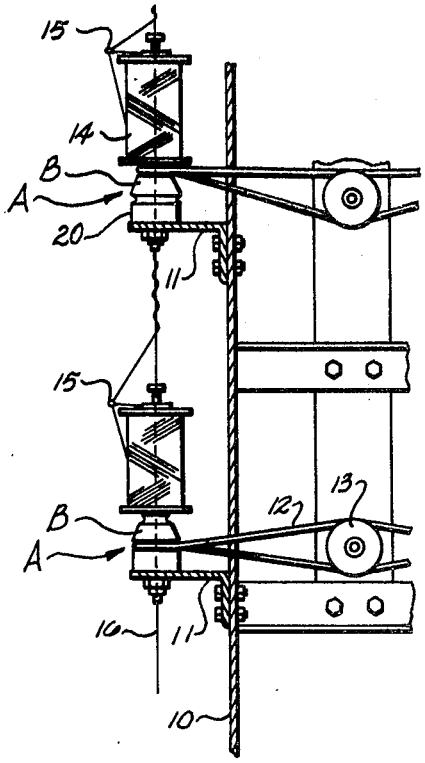
FIG. 2 is an elevation of part of a frame of a conventional rubber covering machine illustrating the spindle and drive arrangement incorporating an adapter pulley member according to the present invention.

The Arnold spindle drive unit of FIG. 1 typically includes a bearing block base 18 on which idler pulley 20 and drive pulley 22 are rotatably carried. The bearing base 18 is mounted to the frame by inserting threaded end **18*a* into an opening in frame element 11 and securing it by nut member 18*b*. A base 23 for holding the yarn package is sandwiched between the pulley 22 and a washer member 24 by means of a hollow tube 25 which is received over a spindle shaft 26. Tube 25 is tightened against washer 24 by means of a threaded portion 25 which cooperates with threads 26*a* on the spindle shaft 26. The base 23 includes a number of tabs 23*a* which hold a paper tube upon which the yarn package is typically formed. Thus, the pulley 22, base 23, and shaft 26, together with the yarn package 14, rotate as a unit as driven by the belt 12. Drive of the spindle unit is effected through manually shifting drive belt 12 from idler pulley 20 to drive pulley 22**.

Figure 3:
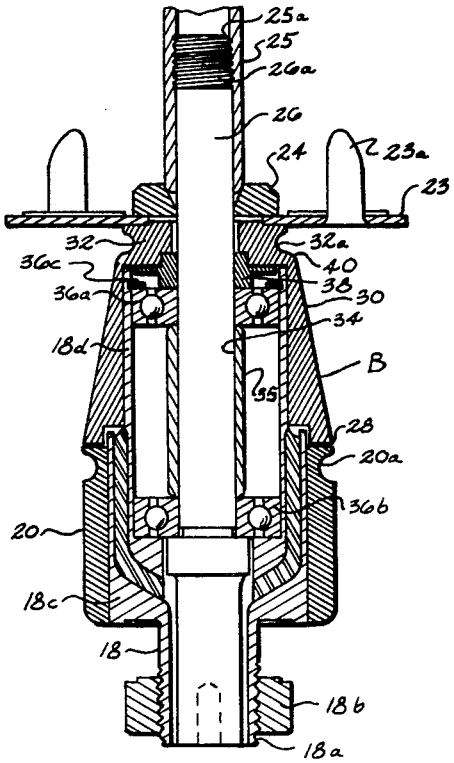
FIG. 3 is a sectional elevation of a spindle drive unit utilizing an adapter pulley member constructed in accordance with the present invention for increasing the drive speed of the spindle.
Figure 4:
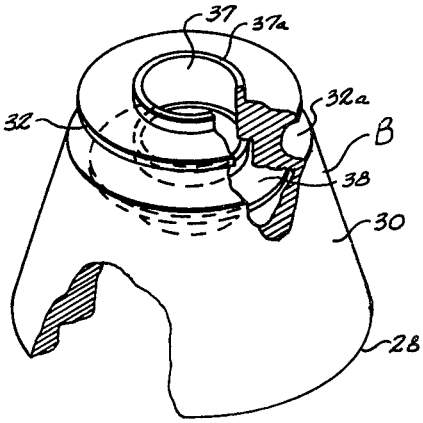
FIG. 4 is a perspective view illustrating an adapter drive pulley member constructed in accordance with the present invention.

Referring now in more detail to FIGS. 3 and 4, the adapter drive member B constructed according to the present invention for increasing the rotational drive speed of the spindle unit is illustrated as including a lower base portion 28 corresponding generally in diameter to idler pulley 20 and a tapered drive belt transfer surface 30 extending from the base portion 28 upwardly and inwardly to a reduced diameter drive pulley portion 32. The drive pulley portion 32 includes a groove **32*a* of reduced circumference relative to the groove 20*a* of the idler pulley 20. The bearing block base 18 includes a lower diameter portion 18*c* about which the idler pulley 20 is carried and an upper diameter portion 18*d*, reduced in diameter, extending above the idler pulley 20. Spindle shaft 26 is received and held in a central bore 34 in bearing block 18 provided by a bearing sleeve 35 interposed between upper and lower ring bearings 36***a* and 36*b* held in place by a slip ring 36*c*. The adapter pulley member includes a central opening 37 through which spindle shaft 26 is received with the adapter pulley member B adapted to be fitted over the upper diameter portion 18*d* with the lower base portion 28 closely adjacent the idler pulley 20. The adapter pulley B is secured to the shaft 26 for unitary rotational motion therewith in the conventional manner through the threaded tube 25 being tightened against washer 24 and, hence, base 23 which fits around a collar flange 37*a* of the adapter pulley member. The entire press fitted assembly, adapter pulley B, yarn package base 23, and shaft 26, ride on upper bearing ring 36*a* by means of an insert 38 pressed into an enlarged portion of the opening 37.

It is noted that the drive pulley portion 32 extends above the upper end of upper diameter portion 18*d* of bearing block 18 and is reduced in its circumference relative to the circumference and diameter of portion 18*d* providing a substantial increase in the rotational drive speed of shaft 26 as compared to the standard drive pulley arrangement. Increased speeds of 50% have been obtained by utilization of the adapter member with resulting production increases.

In operation, the belt 12 is shifted, while being rotated by drive pulley 13, from the idler pulley groove 20*a* to the groove 32*a* of the drive pulley 32 by transfer along the tapered surface 30. It has been found that the drive belt travels reliably and essentially automatically between the pulley grooves by an initial upward or downward pressure such as exerted by a rod on the drive belt. Utilization of tapered drive belt surface 30 provides the additional results that at the junction edge 40 of the transfer surface and the groove 32*a* of the drive pulley member no edge results which wears against the drive belt 12 nor which interferes with belt travel in and out of groove 32*a* affording continuity of belt transfer. The location of the edge junction 40 inwardly radially towardly the shaft 26 avoids any belt wear at the edge due to the drive pulley groove 32*a* being located at the spindle unit at an elevated position and drive belt inclination.

Thus, it can be seen that an advantageous construction for a high speed adapter pulley member for a spindle drive unit can be had according to the invention without modifying the machine or remaining spindle drive unit. The adapter drive pulley member B provides a reduced circumference drive pulley groove and while providing the additional results of reliable drive belt transfer and reduced drive belt wear.

While a preferred embodiment of the invention has been described using specific terms, such description is for illustrative purposes only, and it is to be understood that changes and variations may be made without departing from the spirit or scope of the following claims.

What is claimed is:

1. Textile twisting machine apparatus of the type having belt driven spindles mounted on a frame, each said spindle including a bearing block base adapted for affixation to said frame having a central bearing bore, a driven rotatable spindle shaft received in said central bearing bore and held therein in an upright manner relative to said frame, said bearing block base having a lower diameter portion about which an idler pulley is rotatably carried and an upper diameter portion extending above said idler pulley, wherein the improvement comprises:

an adapter drive pulley member for increasing the rotational drive speed of said spindle shaft including;

a central opening in the top portion of said adapter pulley member for receiving said spindle shaft, a lower base portion corresponding in diameter generally to that of said idler pulley, a reduced diameter drive pulley portion having a groove for receiving a drive belt of said machinery apparatus, a tapered drive belt transfer surface extending upwardly from said lower base portion tapering inwardly terminating at said drive pulley portion facilitating transfer of said drive belt between said idler pulley and reduced drive pulley portion; and said adapter pulley member being carried for unitary rotary motion with said spindle shaft and adapted for being disposed over said upper diameter portion of said bearing block base with lower base portion adjacent said idler pulley.

2. The apparatus of claim 1 wherein the circumference of the groove of said drive pulley portion is reduced beyond that of said upper diameter portion of said bearing block base.

3. The apparatus of claim 1 wherein said tapered belt transfer surface terminates at a level generally at or above an upper end of said bearing block base.

4. The apparatus of claim 1 wherein said tapered belt transfer surface terminates at a junction with the groove of said drive pulley portion facilitating continuity of travel of said drive belt in and out of said groove.

* * * * *